US006793466B2

(12) United States Patent
Miyamoto

(10) Patent No.: US 6,793,466 B2
(45) Date of Patent: Sep. 21, 2004

(54) VACUUM PUMP

(75) Inventor: Matsutaro Miyamoto, Chigasaki (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/967,967

(22) Filed: Oct. 2, 2001

(65) Prior Publication Data

US 2002/0039533 A1 Apr. 4, 2002

(30) Foreign Application Priority Data

Oct. 3, 2000 (JP) ..... 2000-303817

(51) Int. Cl.[7] ..... F04B 23/00; F04B 39/00; F04B 53/00

(52) U.S. Cl. ..... 417/313; 417/423.4; 417/423.8; 415/177

(58) Field of Search ..... 417/313, 366, 417/372, 423.4, 423.8, 423.14, 367, 199.1, 203, 32, 353; 415/90, 178, 175, 177

(56) References Cited

U.S. PATENT DOCUMENTS

| | | | | | |
|---|---|---|---|---|---|
| 4,904,155 | A | * | 2/1990 | Nagaoka et al. | 415/90 |
| 4,926,648 | A | * | 5/1990 | Okumura et al. | |
| 5,190,438 | A | * | 3/1993 | Taniyama et al. | 415/90 |
| 5,350,275 | A | * | 9/1994 | Ishimaru | 415/90 |
| 5,577,883 | A | * | 11/1996 | Schutz et al. | |
| 5,618,167 | A | * | 4/1997 | Hirakawa et al. | 417/372 |
| 5,879,523 | A | * | 3/1999 | Wang et al. | 204/298.11 |
| 5,924,841 | A | * | 7/1999 | Okamura et al. | 415/90 |

FOREIGN PATENT DOCUMENTS

| | | | | |
|---|---|---|---|---|
| JP | 03-290092 | | 12/1991 | |
| JP | 04-164188 | | 6/1992 | |
| JP | 06-12794 | * | 2/1994 | F04D/19/04 |
| JP | 6-159287 A | * | 6/1994 | |
| JP | 06159287 A | * | 6/1994 | F04D/19/04 |
| JP | 08-312581 | | 11/1996 | |
| JP | 9-72293 | * | 3/1997 | |
| JP | 9-072293 A | * | 3/1997 | |
| JP | 2557551 | | 8/1997 | |
| JP | 10-169594 | | 6/1998 | |
| JP | 11-193793 | | 7/1999 | |

* cited by examiner

*Primary Examiner*—Justine R. Yu
*Assistant Examiner*—Han L Liu
(74) *Attorney, Agent, or Firm*—Westerman, Hattori, Daniels & Adrian, LLP

(57) ABSTRACT

A vacuum pump is capable of preventing reaction products produced by a process gas from being precipitated in the pump, of holding various pump components in an allowable temperature range, and hence of operating in a wide operation range, and which has increased durability. The vacuum pump has a pump casing having an intake port and an exhaust port, an exhaust assembly disposed in the pump casing and having a rotor and a stator, and a heating unit for heating a stator side component of the exhaust assembly positioned near the exhaust port. The heating unit is disposed in a space inside the pump casing where is evacuated during operation, and held in contact with at least a portion of the stator side component of the exhaust assembly positioned near the exhaust port.

12 Claims, 7 Drawing Sheets

VACUUM PUMP

BACKGROUND OF THE INVENTION

1. Field of the Invention

The present invention relates to a vacuum pump having an exhaust assembly for evacuating gas through an interaction between a rotor and a stator, and more particularly to a vacuum pump which is capable of operating in a wide operation range by preventing reaction products produced by a process gas from being precipitated inside the pump in a high pressure region on an exhaust port side.

2. Description of the Related Art

One conventional vacuum pump in the form of a turbo-molecular pump is shown in FIG. 7 of the accompanying drawings. As shown in FIG. 7, the turbo-molecular pump has an exhaust assembly comprising a turbine blade exhaust section $L_1$ and a thread groove exhaust section $L_2$ each jointly made up of a rotor R and a stator S which are housed in a cylindrical pump casing 1. The pump casing 1 has a lower portion covered with a pump base 2 to which there is connected an exhaust port member 21 having an exhaust port 20 communicating with an exhaust region of the thread groove exhaust section $L_2$. The pump casing 1 has an intake port 1*a* defined in an upper portion thereof which has a flange 1*b* for connection to a device or a pipe to be evacuated. The stator S mainly comprises a stationary cylindrical sleeve 3 erected centrally in the pump base 2 and stationary components of the turbine blade exhaust section $L_1$ and the thread groove exhaust section $L_2$.

The rotor R comprises a main shaft 4 inserted coaxially in the stationary cylindrical sleeve 3 and a rotary cylindrical sleeve 5 mounted on the main shaft 4. Between the main shaft 4 and the stationary cylindrical sleeve 3, there are disposed a drive motor 6 and an upper radial bearing 7 and a lower radial bearing 8 which are positioned respectively above and below the drive motor 6. An axial bearing 11 is disposed at a lower portion of the main shaft 4, and comprises a target disk 9 mounted on the lower end of the main shaft 4, and upper and lower electromagnets 10*a*, 10*b* provided on the stator S side. The electromagnets 10*a*, 10*b* are disposed respectively above and below the target disk 9. By this magnetic bearing system, the rotor R can be rotated at a high speed under 5-axis active control.

The rotary cylindrical sleeve 5 has rotary blades 12 integrally disposed on its upper outer circumferential region. In the pump casing 1, there are provided stator blades 13 disposed axially alternately interdigitating relation to the rotary blades 12. The rotary blades 12 and the stator blades 13 jointly make up the turbine blade exhaust section $L_1$ which evacuates the gas by way of an interaction between the rotary blades 12 that rotates at a high speed, and the stator blades 13 that remain stationary. The stator blades 13 are secured in position with their circumferential edges vertically held by stator blade spacers 14.

The thread groove exhaust section $L_2$ are positioned beneath the turbine blade exhaust section $L_1$. The rotary cylindrical sleeve 5 has a thread groove barrel 18 disposed around the stationary cylindrical sleeve 3 and having thread grooves 18*a* on its outer circumferential surface. The stator S has a thread groove spacer 19 surrounding the thread groove barrel 18. The thread groove exhaust section $L_2$ evacuates the gas by way of a dragging action of the thread grooves 18*a* of the thread groove barrel 18 which rotates at a high speed.

With the thread groove exhaust section $L_2$ disposed downstream of the turbine blade exhaust section $L_1$, the turbo-molecular pump is of the wide range type capable of handling a wide range of rates of gas flows. In the conventional turbomolecular pump shown in FIG. 7, the thread grooves 18*a* of the thread groove exhaust section $L_2$ are defined in the rotor R side. However, the thread grooves of the thread groove pumping section $L_2$ may be defined in the stator S side.

The turbo-molecular pump may be used with a semiconductor fabrication facility. In such an application, when a process gas is drawn from the intake port 1*a* and discharged from the exhaust port 20, reaction products produced by the process gas tend to be precipitated in the exhaust passage on the exhaust port 20 side which is held under a high pressure, clogging the gap between the rotor R and the stator S or forming deposits on the rotor R. The rotor R is then liable to be brought out of balance and rotate unstably, and possibly locked against rotation, causing a pump failure, when things come to the worst. If the reaction products are deposited until they close the exhaust passage, then the pump undergoes an undue internal pressure buildup, which may prevent the pump from providing a sufficient exhausting capability and may pose an excessive load on the drive motor, resulting in a pump failure.

Various reaction products are formed depending on the process gas used. One typical reaction product is aluminum chloride ($AlCl_3$) that is produced when aluminum is etched. FIG. 8 of the accompanying drawings shows a vapor pressure curve of aluminum chloride. It can be seen from FIG. 8 that aluminum chloride tends to go into a solid phase and become easily solidified in a region where the temperature is low and the partial pressure is high. Because of such a property of aluminum chloride, the gas which is being discharged by the turbo-molecular pump is solidified more easily in thread groove exhaust section $L_2$ than the turbine blade exhaust section $L_1$.

To avoid the above drawback, as shown in FIG. 7, a heater 15 is disposed around the pump casing 1 to transfer its heat to the thread groove spacer 19 to heat the thread groove exhaust section $L_2$ to increase its temperature, and a heater 17 is disposed around the exhaust port member 21 to heat the exhaust port member 21 to increase its temperature.

In order to measure the temperatures increased by the heaters 15, 17 and control the turning on and off of these heaters 15, 17, temperature measuring means such as thermistors, thermocouples, etc. are disposed near the heaters 15, 17, i.e., near heater mounting portions of the pump casing 1 and the exhaust port member 21. These temperature measuring means measure atmospheric side temperatures of these heater mounting portions, and the measured atmospheric side temperatures are used as feedback signals for temperature control.

In order to protect the bearings 7, 8, 11 which support the rotor R, the drive motor 6 which rotates the rotor R, and the entire rotor R against high temperatures achieved when the overall pump is heated, as shown in FIG. 7, a coolant pipe 23 is disposed between the pump base 2 and a lid 22, and a coolant flows through the coolant pipe 23 to cool the bearings 7, 8, 11, the drive motor 6, and the rotor R. The rotor (rotary blades), in particular, is made of an aluminum alloy having a high specific strength, and needs to keep its temperature below an allowable temperature because it has a low high-temperature strength and tends to suffer creeping, i.e., to be deformed while in operation at a high temperature under a high pressure over a long period of time. Generally, it has been customary to control the temperature in the pump by controlling the turning on and off of the heaters and controlling the opening and closing of a solenoid-operated valve (not shown) which is connected to the coolant pipe 23.

With the conventional vacuum pump, the heating means such as heaters are disposed outside of the pump in order to prevent reaction products from being precipitated due to the process gas in a relatively high pressure region in the exhaust passage, and the cooling means is also disposed outside of the pump to prevent the pump from suffering trouble due to high temperatures caused by the heating means. However, these conventional attempts are disadvantageous as follows:

For the purpose of preventing or reducing the precipitation of reaction products to increase the service life of the pump and the durability thereof, the high pressure region in the pump, i.e., on the exhaust port side of the exhaust passage, may be kept at a high temperature. On the other hand, if the problem of the precipitation of reaction products is ignored, then in order to protect a rotor (rotary blade) material which has to be used under a certain allowable stress and in an allowable temperature range, components and materials of the bearings which support the rotor, and components and materials of the drive motor which rotates the rotor, etc. from generation of heat or high temperature regions in the vacuum pump, and to keep those materials durable, these materials need to be isolated from the high temperature regions or need to be cooled if they cannot sufficiently be isolated from the high temperature regions.

Therefore, in order to keep the components of the vacuum pump durable and reduce or prevent the precipitation of reaction products, the region where the reaction products tend to be precipitated has to be held at a high temperature, and the region which needs to be kept in an allowable temperature range has to be isolated from the high temperature regions or cooled by the cooling means.

While the vacuum pump is in normal operation, a low pressure (vacuum) lower than the atmospheric pressure is developed in the pump, and the transfer of heat is blocked in the vacuum, resulting in a vacuum heat-insolating state. In such a vacuum heat-insolating state, when the heating means disposed outside of the pump transfers heat through pump components to increase the temperature of the exhaust passage in the pump, a large loss of heat, i.e., energy, is caused. Particularly, external pump components (casing and housing) that are exposed to the atmosphere produce a large amount of heat radiation, and they have a low heating efficiency. Internal pump components transfer heat possibly to the regions which are not to be heated, such as the bearings, the motor, and the turbine blade exhaust section. When the heat produced by the heaters disposed outside of the pump is transferred, a large amount of heat tends to be consumed, and the pump fails to save energy effectively. In addition, the heating means disposed outside of the pump is likely to be large in size, presenting an obstacle to efforts to make the overall pump compact.

When the temperature of regions in the pump is measured by the temperature measuring means disposed outside of the pump, similar to the heating means, via heat transfer, the temperature measuring means has a low temperature measuring response and accuracy.

SUMMARY OF THE INVENTION

It is therefore an object of the present invention to provide a vacuum pump which is capable of preventing reaction products produced by a process gas from being precipitated in the pump, of holding various pump components in an allowable temperature range, and hence of operating in a wide operation range, and which has increased durability.

To accomplish the above object, there is provided in accordance with the present invention a vacuum pump, comprising: a pump casing having an intake port and an exhaust port; an exhaust assembly disposed in the pump casing and having a rotor and a stator; and a heating unit for heating a stator side component of the exhaust assembly positioned near the exhaust port; wherein the heating unit is disposed in a space inside the pump casing where is evacuated to the vacuum, and held in contact with at least a portion of the stator side component of the exhaust assembly positioned near the exhaust port.

Since the heating unit is held in contact with at least a portion of a region in the pump which is to be heated, the region to be kept at a high temperature can directly be heated. The region can be heated with a very small amount of heat when it is heated in a vacuum heat-insolating state in which no heat is transferred to and from outside of the pump. Because the amount of heat escaping to a region (particularly outside of the pump) other than the region to be heated by way of heat transfer is reduced, the pump is an energy saver and is highly responsive to heating.

The vacuum pump further includes a bearing supporting the rotor, a motor for rotating the rotor, and a cooling unit for cooling at least one of the rotor, the bearing, and the motor.

By efficiently cooling these components, the performance and functions of the bearing and the motor can be maintained as desired. Since the rotor is generally disposed closely to the bearing and the motor, the effect of heat transfer to and from the rotor is large. Therefore, the rotor can efficiently be cooled by cooling the bearing and the motor, and can be kept in an allowable temperature range. As a result, the operation range of the vacuum pump can be increased.

The cooling unit should preferably be positioned as closely to the components to be cooled as much as possible for an increased cooling effect. The heat insulating and transferring regions having large heat capacity should preferably be provided to prevent the cooling effect from acting on an exhaust passage leading to the exhaust port side of the vacuum pump.

A vacuum pump includes a heat insulating member for thermally insulating an intake port side group and an outlet port side group of stator side components of the exhaust assembly from each other.

With the above arrangement, the temperature of the stator near the exhaust port where reaction products tend to be precipitated under high pressure is kept at a high level, and the temperature of the stator near the intake port where the heat is liable to be generated when the rotating rotor agitates the gas being discharged so that the transfer of heat from the rotor to the stator is accelerated to keep the rotor at a low temperature, eventually preventing reaction products from being precipitated and increasing the operation range of the vacuum pump. The heat insulating means, which includes a space such as a gap, may be disposed to separate the stator side components of the exhaust assembly from the pump base integrated the bearings and the motor so that the high temperature state of the stator side components of the exhaust assembly does not affect the bearings and the motor, and the rotor and the shaft positioned near the pump base, preventing the harmful effects by the high temperature.

The vacuum pump further includes a vacuum seal member for sealing a terminal lead-out portion of the heating unit.

The vacuum seal member is effective to prevent the vacuum in a lower pressure region (vacuum region) in the vacuum pump from being broken due to the heating unit disposed in the pump. The response of the vacuum pump to heating is increased, and the energy required by the heating unit is reduced. The vacuum seal member may be an elastic member such as an O-ring, an adhesive member of synthetic resin, or a welded combination of components. If the O-ring seal is used as the vacuum seal member, a vacuum seal recess, in which the vacuum seal member is disposed, may have a rectangular cross section or a triangular cross section from the standpoint of space saving.

The vacuum pump further includes a temperature measuring unit for measuring a temperature of the stator side component of the exhaust assembly positioned near the exhaust port; wherein the temperature measuring unit has a temperature measuring element disposed so as to be held in contact with the stator side component of the exhaust assembly positioned near the exhaust port.

The temperature measuring unit directly measures the temperature of the region which is heated, and hence can measure the temperature highly accurately and produce a measured value as a basis for good temperature control.

The vacuum pump further includes a vacuum seal member for sealing a terminal lead-out portion of the temperature measuring unit.

The vacuum seal member is effective to prevent the vacuum in a lower pressure region (vacuum region) in the vacuum pump from being broken due to the temperature measuring unit disposed in the pump. The response of the vacuum pump to heating can thus be increased.

The exhaust assembly comprises at least one of a turbine blade exhaust section and a thread groove exhaust section.

The exhaust assembly comprises the turbine blade exhaust section and a cooling unit for cooling the turbine blade exhaust section.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 6:
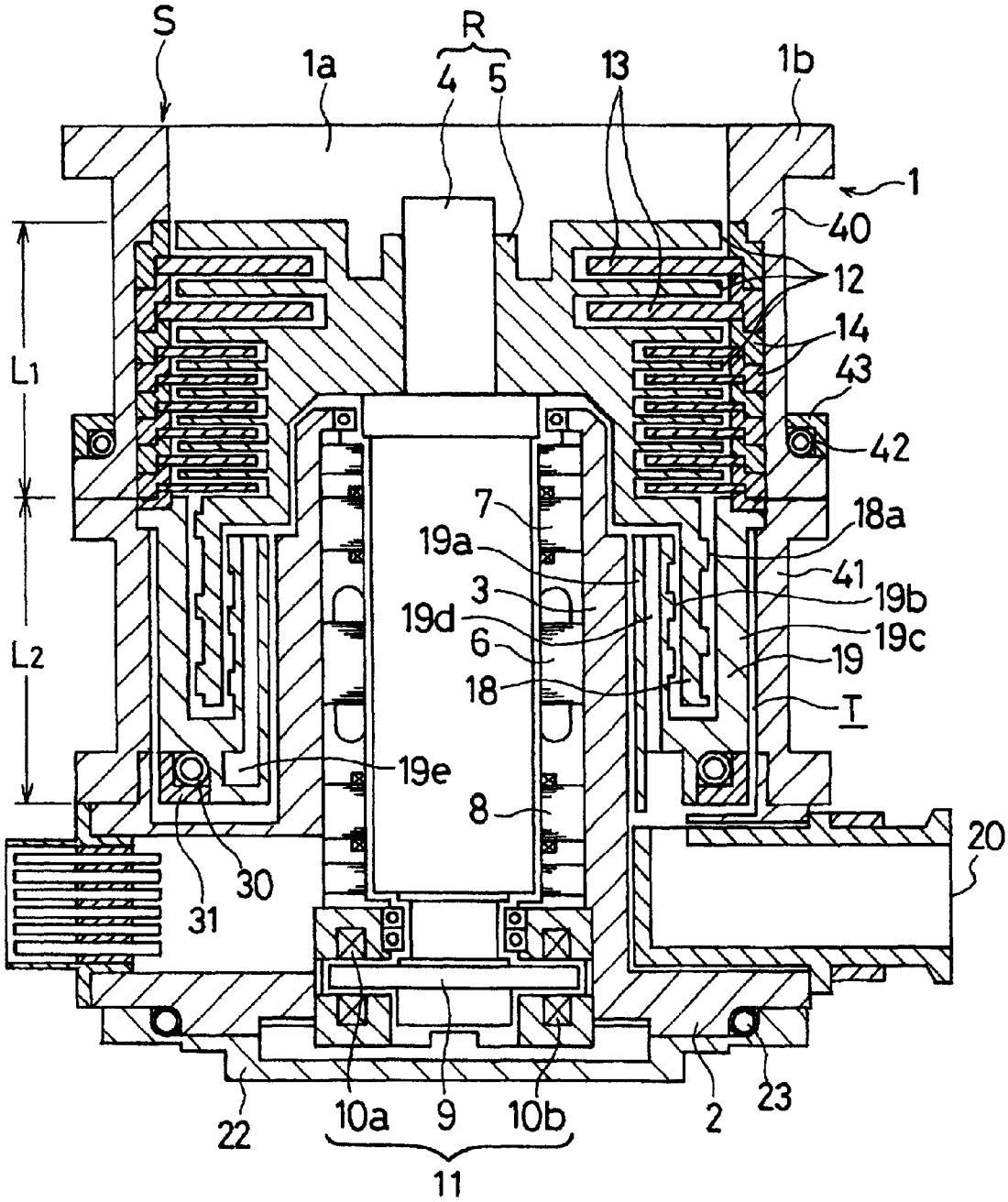
FIG. 6 is a cross-sectional view of a vacuum pump in the form of a turbo-molecular pump according to a third embodiment of the present invention.
Figure 7:
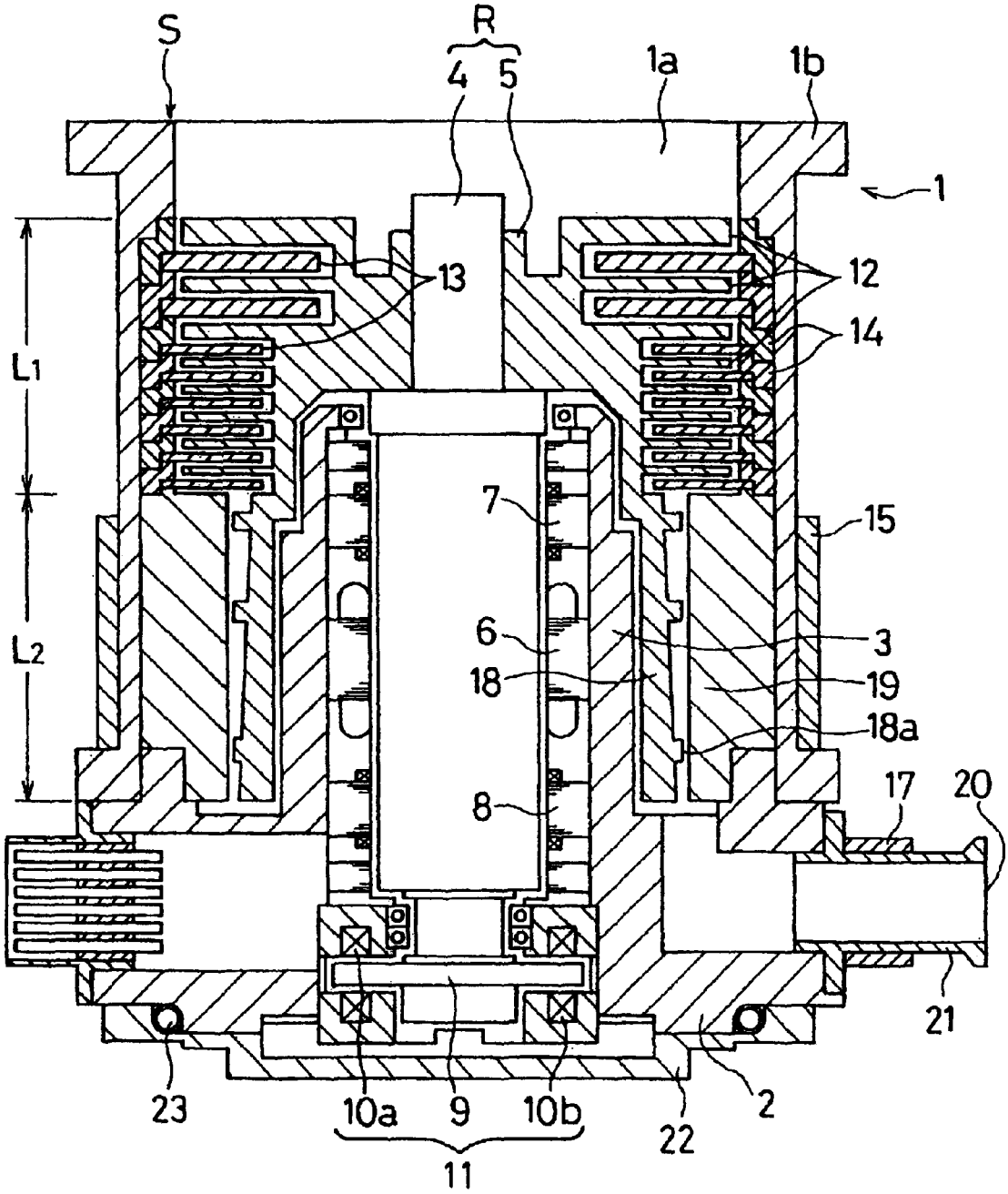
FIG. 7 PRIOR ART
FIG. 7 is a cross-sectional view of a conventional vacuum pump in the form of a turbo-molecular pump.
Figure 8:
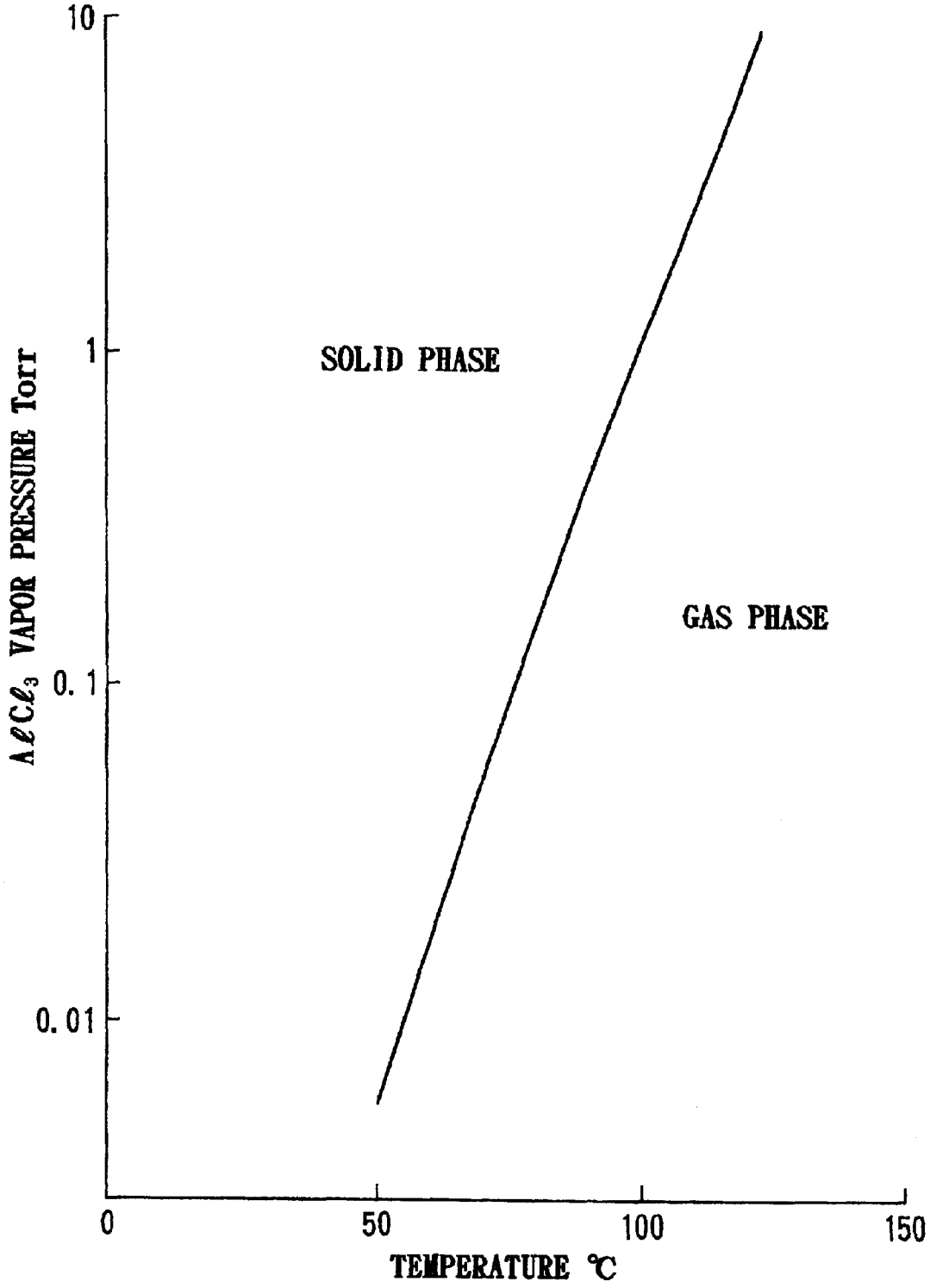
FIG. 8 is a graph showing a vapor pressure curve of aluminum chloride ($AlCl_3$).

Preferred embodiments of the present invention will be described below with reference to FIGS. 1 through 6. Those parts shown in FIGS. 1 through 5 which are identical to or correspond to those shown in FIG. 7 are denoted by identical reference characters, and will not be described in detail below.

FIGS. 1 through 4 show a vacuum pump in the form of a turbo-molecular pump according to a first embodiment of the present invention. The turbo-molecular pump has a ring-shaped heater 30 (heating unit) comprising a pipe. The heater 30 is attached by a cross-sectionally hook-shaped heater holder 31 to a lower portion of a thread groove spacer 19 that is a stator side component of a thread groove exhaust section $L_2$ which is an exhaust assembly near an exhaust port 20 (see FIG. 7). The heater 30 is held in contact with the lower portion of the thread groove spacer 19 over the substantially full length thereof along the circumferential direction for an increased heat transfer efficiency for the transfer of heat to the thread groove spacer 19. However, only a portion of the heater 30 may be held in contact with the lower portion of the thread groove spacer 19. The ring shape of the heater 30 is an example, and the heater 30 may be of any desired shape in view of production and performance considerations.

The heater 30 has a pair of downwardly extending portions 30*a* on its opposite ends which are bent downwardly at a right angle and extend parallel to each other. An elliptical flange 32 is attached to the lower ends of the downwardly extending portions 30*a*. A temperature sensor (temperature measuring unit) 33 is positioned between the downwardly extending portions 30*a* and has a lower portion extending through the flange 32. The temperature sensor 33 has its temperature measuring element on its tip end which is held in direct contact with the thread groove spacer 19.

The flange 32 has an outer shape complementary to the inner shape of a through hole 2*a* defined in a pump base 2 and the inner shape of a through hole 34*a* defined in an inner wiring pipe 34. A vacuum seal member 35 is disposed in a step (vacuum seal recess) defined between the pump base 2 and the inner wiring pipe 34. When the vacuum seal member 35 is vertically gripped between the pump base 2 and the inner wiring pipe 34, the vacuum seal member 35 expands horizontally with its inner circumferential edge pressed against the outer circumferential surface of the flange 32 to keep the vacuum from being broken. Therefore, while the pump is in operation, a pressure (vacuum) in the pump is developed above the flange 32, and the atmospheric pressure is present below the flange 32.

The vacuum seal recess is shown as being of a rectangular cross section. However, the vacuum seal recess may have a triangular cross section from the standpoints of space saving and increased sealing reliability, or may have any desired cross section in view of production and assembling considerations. Alternatively, the vacuum and the atmospheric pressure may be isolated from each other by bonding, welding, or the like in place of the O-ring seal.

The heating element of the heater 30 and the temperature measuring element and head of the temperature sensor 33 are held out of direct contact with the exhaust gas within the pump. Specifically, the heating element of the heater 30 is embedded in the pipe thereof and held under the atmospheric pressure within the pipe. Therefore, the heating element does not cause an operation failure due to corrosion and insulation failure, and is free from concern over a vacuum discharge or fusion in the vacuum. Therefore, the heating means and the temperature measuring means can be realized according to simple and cheap specifications.

The pipe of the heater 30 may be made of a metal material such as stainless steel or the like which is of high heat conductivity, resistant to corrosion, highly ductile, and easily machinable. Materials of less corrosion resistance may also be used if they are processed by a corrosion-resistant surface treatment such as nickel plating.

The wires extending from the heater 30 and the temperature sensor 33 extend through the inner wiring pipe 34 and are connected to a connector 36 in the atmosphere, which is connected to a controller for controlling the turning on and off of the heater 30 based on the measured temperature.

Since the heater 30 is disposed in the pump in which a low pressure (vacuum region) is developed during operation of the pump, and the heater 30 is held in direct contact with the thread groove spacer 19 to be heated, the thread groove spacer 19 can directly be heated by the heater 30. Because the temperature measuring element of the temperature sensor 33 is held in contact with the thread groove spacer 19, the temperature of the thread groove spacer 19 which is heated can directly be measured. Furthermore, inasmuch as the terminal lead-out portions of the heater 30 and the temperature sensor 33 are sealed by the vacuum seal member 35 and the heater 30 and the temperature sensor 33 are disposed in the pump in which a low pressure (vacuum region) is developed, the vacuum in the pump is prevented from being broken.

The heater 30 and the temperature sensor 33 should preferably be installed according to such an installation process and with such an installation structure that they will not be damaged when the rotor R is destroyed. Specifically, the portions of the heater 30 and the temperature sensor 33 which are attached to the thread groove spacer 19 may intentionally be lowered in strength in order to prevent the heater 30 and the temperature sensor 33 from rotating in unison with the thread groove spacer 19 even when the thread groove spacer 19 is rotated, or lock pins may be used to prevent the heater 30 and the temperature sensor 33 from rotating in unison with the thread groove spacer 19 even when the thread groove spacer 19 is rotated. For the purpose of preventing the heater 30 and the temperature sensor 33 from being damaged, the heater 30 and the temperature sensor 33 may be positioned radially inwardly of the outer edge of the rotor R, the heater 30 and the temperature sensor 33 may be attached to the thread groove spacer 19 at locations out of the area of the thread groove spacer 19 which confronts the rotor R.

In the present embodiment, there is a gap T between the outer circumferential surface of the thread groove spacer 19 and the inner circumferential surface of a pump casing 1. The gap T is effective to prevent the heat of the thread groove spacer 19 from being directly transferred to the pump casing 1 and hence to prevent a large amount of heat from being radiated from the pump casing 1 that is exposed to the atmosphere.

Furthermore, in the present embodiment, the pump casing 1 comprises an upper casing 40 surrounding a turbine blade exhaust section $L_1$ and a lower casing 41 surrounding a thread groove exhaust section $L_2$. A coolant pipe 42 is attached to the outer circumferential surface of a lower portion of the upper casing 40 via a pipe pressing member 43. When a coolant flows through the coolant pipe 42, it forcibly cools stator blades 13 and stator blade spacers 14 of the turbine blade exhaust section $L_1$.

Generally, the turbine blade exhaust section of a turbomolecular pump is designed to perform an exhausting capability sufficiently in a pressure range of a molecular flow region where the collision of gas molecules can be ignored. Therefore, when the amount of a gas flowing in from the intake port side of the vacuum pump increases and the molecular flow region changes to a viscous flow region where the viscosity of the gas cannot be ignored, the amount of generated heat increases sharply due to the agitation of the gas with the rotor of the turbine blade exhaust section, increasing the temperature of the rotor (rotary blades). Since the rotary blades are generally made of an aluminum alloy, their high temperature strength is low and the rotary blades tend to cause creeping. Therefore, the rotary blades have to be kept in an allowable temperature range. In order to set the amount of a gas that can be discharged to a wide range or to allow the vacuum pump to operate in a wide range of pressures, it is important that the temperature of the stator of the turbine blade exhaust section be lowered, and the temperature of the rotor be kept at a low temperature by the radiation of heat from the rotor to the stator of the turbine blade exhaust section, which radiation is accelerated by the lowered temperature of the stator of the turbine blade exhaust section.

As described above, the stator blades 13 and stator blade spacers 14 of the turbine blade exhaust section $L_1$ are selectively forcibly cooled, and a heat insulating spacer 44, described later on, is disposed on an intake side of the thread groove exhaust section $L_2$ where the pressure increases and reaction products tend to be precipitated so as to prevent the cooling from affecting the thread groove exhaust section $L_2$. In this manner, the vacuum pump can operate in a wide range, and reaction products are prevented from being precipitated.

The coolant flows through the coolant pipe 23 disposed between the pump base 2 and the lid 22 to forcibly cool the pump base 2 that is thermally insulated from the thread groove spacer 19. The thread groove spacer 19 and the pump base 2 may be thermally insulated from each other by minimizing their areas of contact or adding an insulating material therebetween. Furthermore, the thread groove spacer 19 may be secured by vertically gripped its upper portion between the turbine blade exhaust section $L_1$ and a thread groove exhaust section $L_2$, as shown in FIG. 6, having a space between other portion of the thread groove spacer 19 and the rotor. By thus forcibly cooling the pump base 2, not only a drive motor 6 and bearings 7, 8, 11 are cooled, but the heat radiated from the rotor R to the stator S inside of the rotor R and outside of the stationary cylindrical sleeve 3 increase, lowering the temperature of the rotor R. As a result, the operation range of the vacuum pump that is limited by the rotor temperature can be widened. The means for cooling the motor and the bearings should preferably be positioned as closely as possible to the stationary cylindrical sleeve where the drive motor and the bearings are incorporated.

In the present embodiment, a heat insulating spacer 44 made of a material of low heat conductivity such as ceramics is disposed between the stator blade 13 and the stator blade spacer 14 which are positioned in the lowermost position of the turbine blade exhaust section $L_1$, and the thread groove spacer 19 of the thread groove exhaust section $L_2$. The heat insulating spacer 44 is effective to provide a high temperature gradient between the stator blade 13 and the stator blade spacer 14 of the turbine blade exhaust section $L_1$, and the thread groove spacer 19 of the thread groove exhaust section $L_2$, resulting in an increased operation range of the vacuum pump which is limited by the rotor temperature without impairing the effect of the temperature drop of the rotor R due to the radiation of heat from the rotor R in the turbine blade exhaust section $L_1$.

Specifically, the gab between the thread groove barrel 18 and the thread groove spacer 19 in the thread groove exhaust section $L_2$ is set to a small dimension of about 1 mm or less for the purpose of maintaining a required exhausting capability. If reaction products are precipitated in the gap, then the rotor R may be immediately locked or fails to rotate. Therefore, it is necessary to hold the region at a high temperature for preventing reaction products from being precipitated. On the other hand, in the turbine blade exhaust section $L_1$, when the amount of the gas being discharged is large, the rotor tends to produce a large amount of heat as it agitates the gas. Therefore, it is necessary to lower the temperature of the rotor due to the transfer of heat from the rotor to the stator.

The thread groove spacer 19 as a stator side component in the thread groove exhaust section $L_2$, that is positioned exhaust side of the exhaust assembly, is of a high temperature in order to prevent reaction products from being precipitated, as described above. Therefore, the transfer of heat due to heat radiation is effective in an area where the rotor and the stator are close to each other, except for the thread groove spacer 19. Specifically, such an area is an area within the rotor where the rotor and the stator are close to each other or an intake port side of the exhaust section, or more specifically, the turbine blade exhaust section $L_1$.

Thus, by thermally insulating the stator side of the turbine blade exhaust section $L_1$ and the stator side of the thread groove exhaust section $L_2$ from each other so as to lower the temperature of the stator side of the turbine blade exhaust section $L_1$, in the turbine blade exhaust section $L_1$, the amount of heat radiation from the rotor increases, lowering the temperature of the rotor. Therefore, the operation range of the vacuum pump which is limited by the rotor temperature can be increased.

In the present embodiment, the thread groove spacer 19 is formed outside of the rotor R only. However, the thread groove spacer may be extended into inside of the rotor in order to increase the gas passage in the thread groove exhaust section for an increased exhausting capability, as shown in FIG. 6. In such a modification, the thread groove spacer extends from outside of the rotor across the lower end thereof into inside of the rotor, and may serve as a region which is heated and whose temperature is measured. With this arrangement, the vacuum pump has an increased exhausting capability, and the thread groove spacer, facing the inside of the rotor in a high pressure region, is kept precisely at high temperature.

Figure 1:
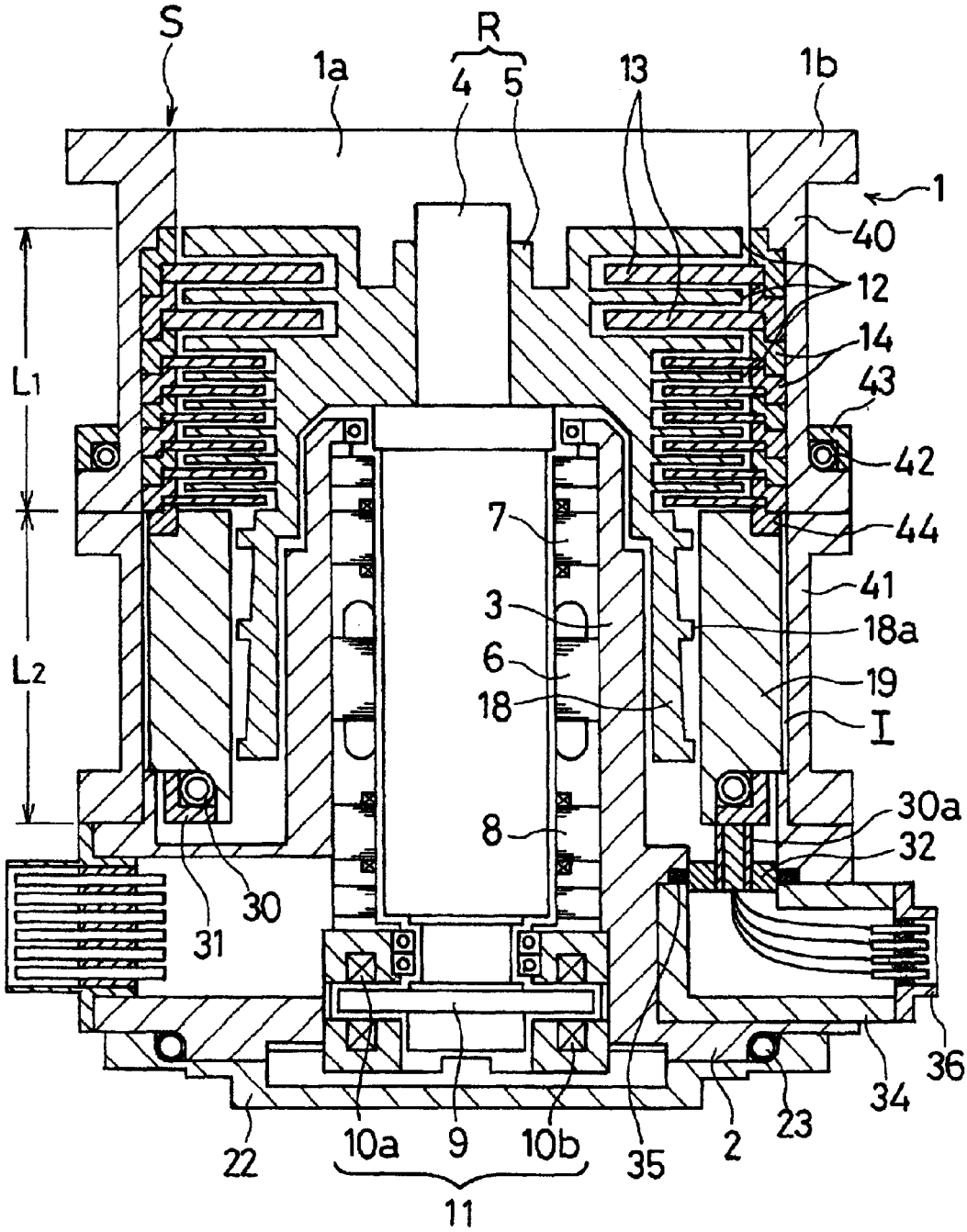
FIG. 1 is a cross-sectional view of a vacuum pump in the form of a turbo-molecular pump according to a first embodiment of the present invention.
Figure 2:
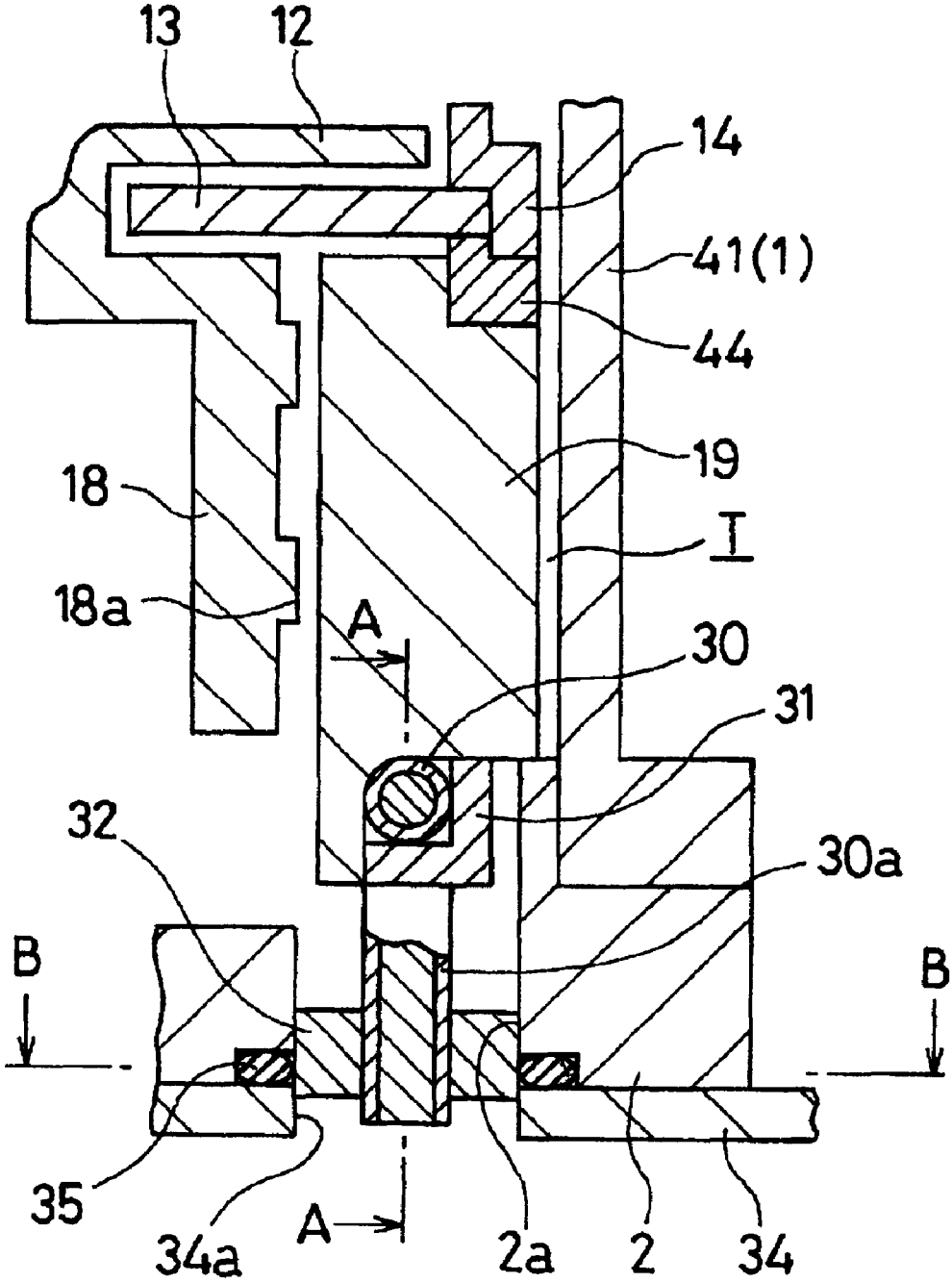
FIG. 2 is an enlarged cross-sectional view of a portion of the vacuum pump shown in FIG. 1.
Figure 3:
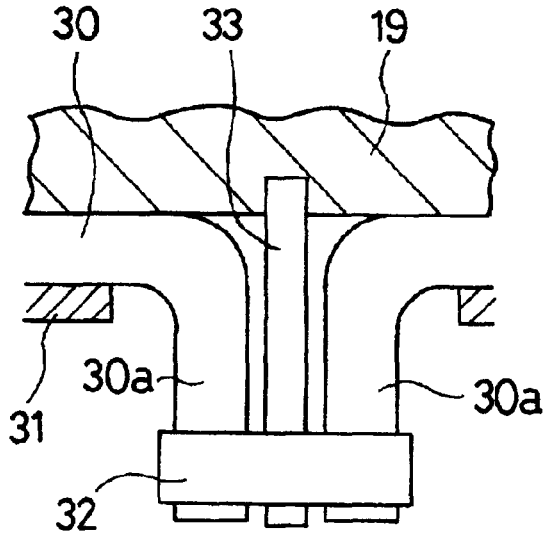
FIG. 3 is a cross-sectional view taken along line A—A of FIG. 2.
Figure 4:
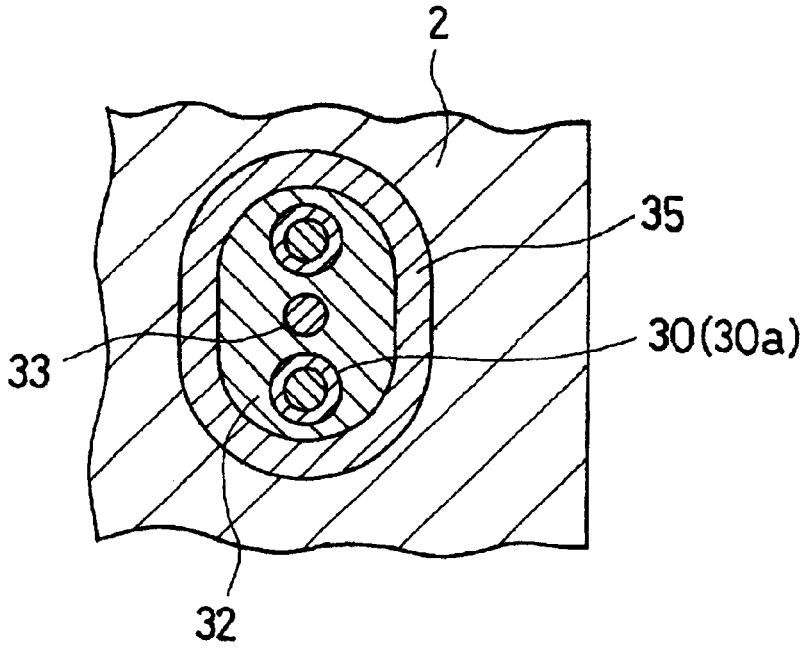
FIG. 4 is a cross-sectional view taken along line B—B of FIG. 2.
Figure 5:
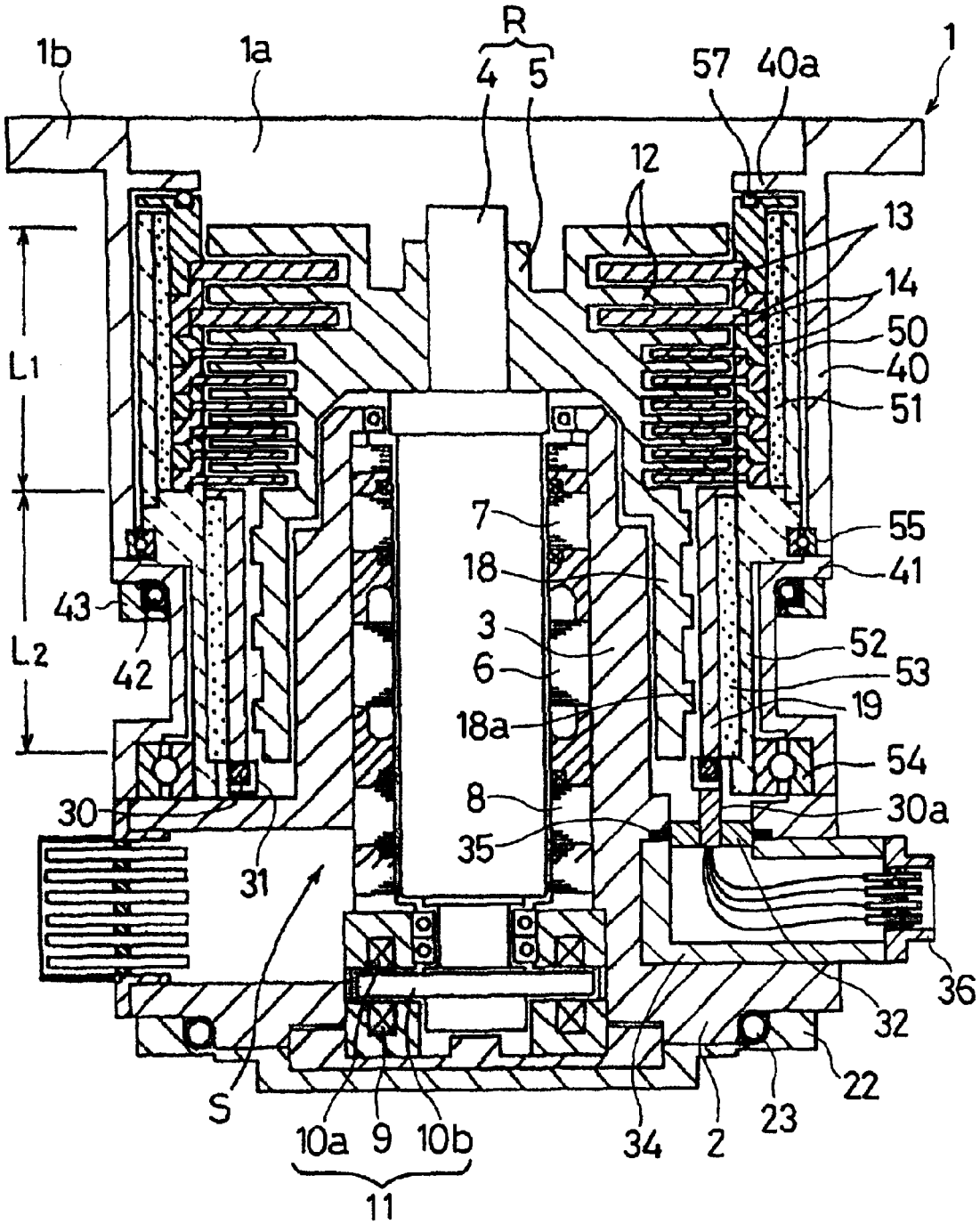
FIG. 5 is a cross-sectional view of a vacuum pump in the form of a turbo-molecular pump according to a second embodiment of the present invention.

FIG. 5 shows a vacuum pump in the form of a turbo-molecular pump according to a second embodiment of the present invention. The turbo-molecular pump according to the second embodiment has a torque reducing mechanism for lowering the torque which is produced when the rotor is destroyed.

Specifically, an inner upper casing 50 is disposed in the upper casing 40 with a given gap therebetween, and a shock absorbing member 51 is disposed between the inner upper casing 50 and the stator blade spacers 14. An inner lower casing 52 is disposed in the lower casing 41 with a given gap therebetween, and a shock absorbing member 53 is disposed between the inner lower casing 52 and the thread groove spacer 19. The inner lower casing 52 is supported by mechanical bearings 54, 55 on upper and lower portions thereof of its outer circumferential surface. An O-ring-shaped or sheet-like seal member 57 of fluorine rubber, for example, is disposed between a flange 40*a* projecting inwardly from an inner surface of the upper casing 40 and the stator blade spacer 14 on the uppermost end of the turbine blade exhaust section $L_1$. The coolant pipe 42 is disposed on an upper portion of the lower casing 41, in the present embodiment. Other structural details of the vacuum pump according to the second embodiment are substantially identical to those of vacuum pump according to the first embodiment.

If the rotor R suffers a rotation failure or is broken for some reason, then the torque of the rotor R is transmitted to the shock absorbing members 51, 53, which absorbs the shock. When the shock is transmitted beyond the shock absorbing members 51, 53, the region surrounded by the mechanical bearings 54, 55 and the seal member 57 rotates in unison with the rotor R, absorbing the shock further.

With the above arrangement, the torque produced when the rotor is destroyed is reduced to keep the vacuum pump safe. In addition, reaction products are also prevented from being precipitated to increase the operation range of the pump which is limited by the rotor temperature.

FIG. 6 shows a vacuum pump in the form of a turbo-molecular pump according to a third embodiment of the present invention. In this present embodiment, the thread groove spacer 19 is of a double-walled cylindrical structure, and has thread grooves on its surface facing the thread groove barrel 18 or and/or is confronted by thread grooves on the thread groove barrel 18. Specifically, the thread groove barrel 18 has thread grooves 18*a* on an outer surface thereof and the thread groove spacer 19 has thread grooves 19*b* on an outer surface of its inner cylinder 19*a*. The vacuum pump shown in FIG. 6 is by way of illustrative example only, and the thread grooves may be provided on one or both confronting surfaces of the thread groove barrel and the thread groove spacer. With the arrangement shown in FIG. 6, the gas flowing from the thread groove exhaust section $L_2$ is exhausted through an exhaust passage defined between an inner surface of the outer cylinder 19*c* of the thread groove spacer 19 and an outer surface of the thread groove barrel 18, flows around the lower end of the thread groove barrel 18, is exhausted again through an exhaust passage defined between an outer surface of the inner cylinder 19*a* of the thread groove spacer 19 and an inner surface of the thread groove barrel 18, and finally flows through axial holes 19*d* and a circumferential hole 19*e* both defined in the inner cylinder 19*a* of the thread groove spacer 19 into the outlet port of the pump.

Even through the thread groove exhaust section of the vacuum pump shown in FIG. 6 has an increased exhaust passage length, the vacuum pump has an increased exhausting capability and the exhaust components near the exhaust port 20 of the pump can be kept at a high temperature by directly heating the thread groove spacer and thermally insulating the thread groove spacer from the other stator region.

The thread groove spacer 19 itself may comprise a heating member such as a ceramic heater or the like. If the thread groove spacer 19 comprises a heating member, then any attachment for attaching a heater is not required, and the thread groove spacer 19 does not suffer local temperature variations but can be maintained at a uniform high temperature.

The leads of the heater, etc. may extend to the atmospheric side of the vacuum pump through not only the pump base, but also a region which may easily be selected, such as a junction between the pump casing and the pump base or a junction between the upper casing and the lower casing. Since any thermal transference between the thread groove spacer 19 and the other stator region in the pump casing is minimized, the thread groove spacer 19 may be fixed in the above area where the leads of the heater, etc. extend to the atmospheric side of the vacuum pump.

In the above embodiments, the present invention is applied to the wide-range turbo-molecular pump having the turbine blade exhaust section $L_1$ and the thread groove exhaust section $L_2$. However, the principles of the present invention are also applicable to a pump having only the turbine blade exhaust section $L_1$ or the thread groove exhaust section $L_2$. The principles of the present invention are also applicable to a vacuum pump of any exhaust system configuration where the rotor and the stator in the thread groove exhaust section may comprise disks disposed alternately in the axial direction with grooves defined in one or both of the rotor and the stator to provide an exhaust passage system. Some or all of the above embodiments and modifications may also be combined with each other.

According to the present invention, as described above, reaction products produced due to the gas being discharged are prevented from being precipitated in the pump, and the various components of the pump are kept in allowable temperature ranges. Thus, the operation range of the vacuum pump can be increased, and the durability of the vacuum pump is increased.

Although certain preferred embodiments of the present invention has been shown and described in detail, it should be understood that various changes and modifications may be made therein without departing from the scope of the appended claims.

What is claimed is:

1. A vacuum pump, comprising:

a pump casing having an intake port and an exhaust port;

an exhaust assembly disposed in said pump casing and having a rotor and a stator; and a heating unit for heating a stator side component of said exhaust assembly positioned near said exhaust port;

wherein said heating unit attached to said exhaust assembly near said exhaust port and disposed in a space inside said pump casing that is evacuated to the vacuum, and is held in contact with at least a portion of said stator side component of said exhaust assembly positioned near said exhaust port.

2. A vacuum pump according to claim 1, further comprising:

a bearing supporting said rotor;

a motor for rotating said rotor; and a cooling unit for cooling at least one of said rotor, said bearing, and said motor.

3. A vacuum pump according to claim 1, further comprising a heat insulating member for thermally insulating an intake port side group and an outlet port side group of stator side components of said exhaust assembly from each other.

4. A vacuum pump according to claim 1, further comprising a vacuum seal member for sealing a terminal lead-out portion of said heating unit.

5. A vacuum pump according to claim 1, further comprising a temperature measuring unit for measuring a temperature of said stator side component of said exhaust assembly positioned near said exhaust port; wherein said temperature measuring unit has a temperature measuring element disposed so as to be held in contact with said stator side component of said exhaust assembly positioned near said exhaust port.

6. A vacuum pump according to claim 5, further comprising a vacuum seal member for sealing a terminal lead-out portion of said temperature measuring unit.

7. A vacuum pump according to claim 1, wherein said exhaust assembly comprises at least one of a turbine blade exhaust section and a thread groove exhaust section.

8. A vacuum pump according to claim 7, wherein said exhaust assembly comprises said turbine blade exhaust section and a cooling unit for cooling said turbine blade exhaust section.

9. A vacuum pump according to claim 7, further comprising a heat insulating member for thermally insulating an intake port side group and an outlet port side group of stator side components of said exhaust assembly from each other.

10. A vacuum pump according to claim 7, further comprising a vacuum seal member for sealing a terminal lead-out portion of said heating unit.

11. A vacuum pump according to claim 7, further comprising a temperature measuring unit for measuring a temperature of said stator side component of said exhaust assembly positioned near said exhaust port; wherein said temperature measuring unit has a temperature measuring element disposed so as to be held in contact with said stator side component of said exhaust assembly positioned near said exhaust port.

12. A vacuum pump according to claim 11, further comprising a vacuum seal member for sealing a terminal lead-out portion of said temperature measuring unit.

* * * * *

UNITED STATES PATENT AND TRADEMARK OFFICE

CERTIFICATE OF CORRECTION

PATENT NO. : 6,793,466 B2
DATED : September 21, 2004
INVENTOR(S) : Matsutaro Miyamoto It is certified that error appears in the above-identified patent and that said Letters Patent is hereby corrected as shown below:

Column 11,
Line 37, please add -- is -- between “unit” and “attached”.

Signed and Sealed this

Second Day of August, 2005

JON W. DUDAS
*Director of the United States Patent and Trademark Office*